US008647077B2

(12) United States Patent
Vinson et al.

(10) Patent No.: US 8,647,077 B2
(45) Date of Patent: Feb. 11, 2014

(54) COOLING FAN FOR ELECTRONIC DEVICE

(75) Inventors: Wade D. Vinson, Magnolia, TX (US); John P. Franz, Houston, TX (US); Yousef Jarrah, Tucson, AZ (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2741 days.

(21) Appl. No.: 10/783,162

(22) Filed: Feb. 20, 2004

(65) Prior Publication Data

US 2005/0186096 A1 Aug. 25, 2005

(51) Int. Cl.
*F04B 39/00* (2006.01)

(52) U.S. Cl.
USPC ..... 417/313; 417/423.1; 417/222.2

(58) Field of Classification Search
USPC ..... 417/313, 423.1, 222.2; 416/223 R, 243, 416/DIG. 2, DIG. 5, DIG. 3; 361/690–697
See application file for complete search history.

(56) References Cited

U.S. PATENT DOCUMENTS

| | | | | |
|---|---|---|---|---|
| 1,755,633 | A * | 4/1930 | Dehmer | 416/223 R |
| 3,586,949 | A | 6/1971 | Spear et al. | |
| 4,107,587 | A | 8/1978 | Ban et al. | |
| RE30,761 | E | 10/1981 | Ban et al. | |
| 4,403,177 | A | 9/1983 | Weber et al. | |
| 4,732,532 | A * | 3/1988 | Schwaller et al. | 415/119 |
| 4,882,511 | A | 11/1989 | von der Heide | |
| 5,164,622 | A | 11/1992 | Kordik | |
| 5,184,938 | A * | 2/1993 | Harmsen | 416/223 R |
| 5,270,622 | A | 12/1993 | Krause | |
| 5,280,209 | A * | 1/1994 | Leupold et al. | 310/156.41 |
| 5,418,416 | A | 5/1995 | Muller | |
| 5,445,215 | A * | 8/1995 | Herbert | 165/80.3 |
| 5,493,189 | A | 2/1996 | Ling et al. | |
| 5,588,804 | A * | 12/1996 | Neely et al. | 416/223 R |
| 5,650,678 | A * | 7/1997 | Yokozawa et al. | 310/90 |
| 5,652,470 | A * | 7/1997 | von der Heide et al. | 310/67 R |
| D398,978 | S * | 9/1998 | Horng | 16/445 |
| 5,834,873 | A | 11/1998 | Muller | |
| 5,867,365 | A * | 2/1999 | Chiou | 361/690 |
| 5,909,072 | A * | 6/1999 | Muller | 310/68 B |
| 5,910,694 | A * | 6/1999 | Yokozawa et al. | 310/89 |
| 6,129,528 | A * | 10/2000 | Bradbury et al. | 417/423.1 |
| 2004/0170501 | A1 * | 9/2004 | Seki | 416/223 R |
| 2005/0106027 | A1 * | 5/2005 | Harvey | 416/223 R |

* cited by examiner

*Primary Examiner* — Charles Freay
*Assistant Examiner* — Vikansha Dwivedi

(57) ABSTRACT

A cooling fan having motor and an impeller. The cooling fan may comprise a three-phase DC motor. The impeller may comprise a hub to house the three-phase DC motor and a plurality of blades extending from the hub. Each blade may have a height that is at least 25 % of the impeller diameter.

27 Claims, 5 Drawing Sheets

COOLING FAN FOR ELECTRONIC DEVICE

BACKGROUND OF THE RELATED ART

This section is intended to introduce the reader to various aspects of art, which may be related to various aspects of the present invention that are described and/or claimed below. This discussion is believed to be helpful in providing the reader with background information to facilitate a better understanding of the various aspects of the present invention. Accordingly, it should be understood that these statements are to be read in this light, and not as admissions of prior art.

Electronic devices typically consist of a variety of electrical components. These components may generate substantial amounts of heat that can damage or inhibit the operation of the electronic device. Consequently, electronic devices commonly use cooling fans to remove heat generated within the electronic device by the electrical components.

BRIEF DESCRIPTION OF THE DRAWINGS

Exemplary embodiments of the present invention may be apparent upon reading of the following detailed description with reference to the drawings in which.

DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
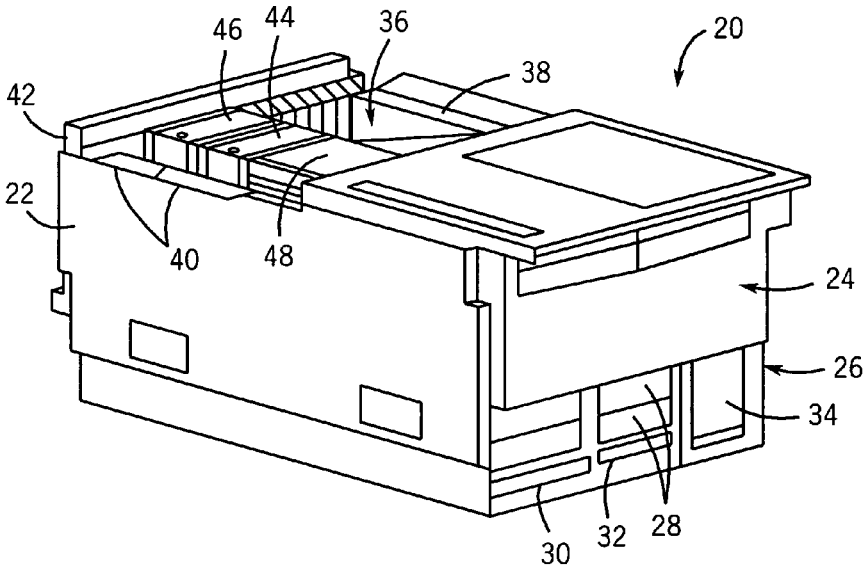
FIG. 1 is a perspective view illustrating a server in accordance with embodiments of the present invention.

Referring generally to FIG. 1, an electronic device 20 is illustrated. In the illustrated embodiment, the electronic device 20 is a server. A server is a computer that provides services to other computers. For example, a file server is a computer that stores files that may be accessed by other computers via a network. Another type of server is an application server. An application server is a computer that enables other computers to perform large or complicated tasks. However, the techniques described below may be applicable to electronic devices other than servers, such as other types of computers, televisions, etc.

The illustrated server 20 has a chassis 22 that supports the components of the server 20. One of the components of the server 20 that is supported by the chassis 22 is a processor module 24 that houses a plurality of processors. The processor or processors in processor module 24 enable the server 20 to perform its intended functions, such as functioning as a file server or as an application server. To perform these functions, the processor module 24 processes data from various sources. Some of these sources of data are housed within a memory module 26. The memory module 26 may comprise one or more data storage devices that are operable to store data and transmit the data to the processors in the processor module 24. In this embodiment, the data storage devices comprise several hard disk drives 28, a CD-ROM drive 30, and a diskette drive 32. However, the memory module 26 may comprise other data storage devices. The illustrated server 20 also comprises a control panel 34 to enable a user to monitor and control various server functions.

Another component that may be supported by the chassis 22 is an Input/Output ("I/O") module 36. The I/O module 36 is adapted to receive a plurality of I/O cards 38 for communicating with other computers and electronic devices via a network, such as the Internet. The I/O cards 38 enable data to be transferred between the processor module 24 and external devices via the network. In addition, the illustrated I/O module 36 houses one or more power supplies, such as a pair of power supplies 40. In the illustrated embodiment, the power supplies 40 are redundant, i.e., one of the power supplies 40 is operating at all times and the other power supply is idle, but ready to operate if requested by the server 20. In addition, the power supplies 40 are hot-pluggable, i.e., the power supplies 40 may be removed and installed while the server 20 is operating. In this embodiment, the I/O module 36 has its own chassis 42 that is disposed within the server chassis 22.

Figure 2:
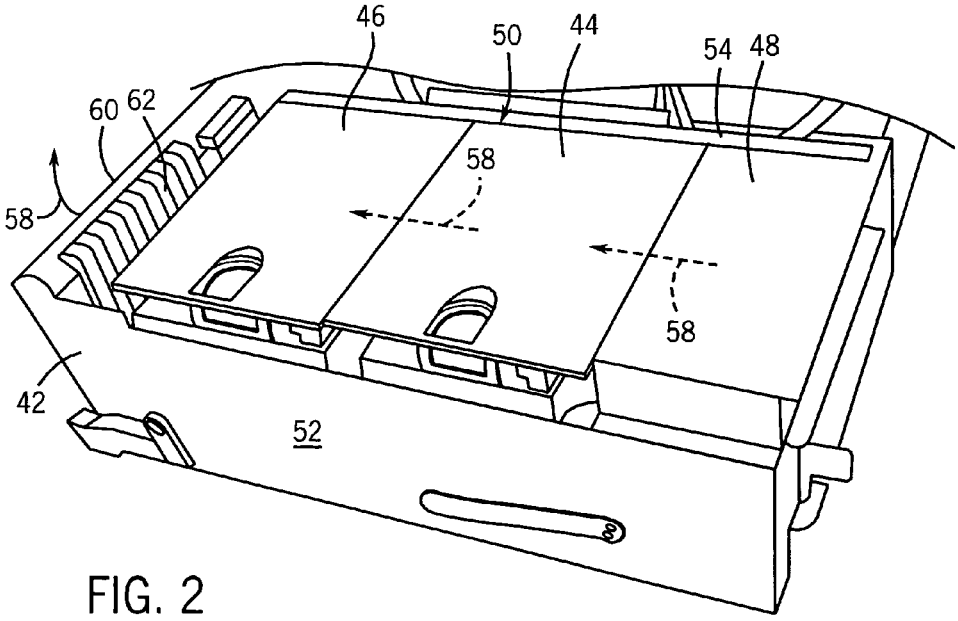
FIG. 2 is a perspective view of a portion of the server of FIG. 1 illustrating an exemplary redundant cooling fan system in accordance with embodiments of the present invention.

Referring generally to FIGS. 1 and 2, a first fan 44 and a second fan 46 are provided to produce a flow of air to cool the components housed within the server 20. The server 20 is operable to control the operation of the first fan 44 and the second fan 46. In this embodiment, the first fan 44 and the second fan 46 are identical. In addition, the first fan 44 and the second fan 46 are redundant fans. As with the power supplies 40, one fan may be operating at all times, while the other fan is idle. Thus, at any point in time, either the first fan 44 or the second fan 46 is operating. When a problem occurs with the operating fan, the server 20 starts the idle fan. However, the server 20 may be configured to operate both the first fan 44 and the second fan 46 at the same time. In addition, the first fan 44 and the second fan 46 are each hot-pluggable, i.e., they may be removed and installed with the server 20 operating.

As best illustrated in FIG. 2, the first fan 44 and the second fan 46 are oriented in series. A shroud 48 is provided to direct air into the first fan 44. The first fan 44 and the second fan 46 define a fan tunnel 50 that directs the flow of air through the fans. The fan tunnel 50 also comprises a side 52 of the I/O module chassis 42 and a partition 54 that extends along the sides of the first fan 44 and second fan 46. Depending upon which of the two fans is operating, either the first fan 44 is blowing air 58 through the second fan 46 or the second fan 46 is drawing air 58 through the first fan 46. The operating fan draws air 58 into the server 20, cooling the components housed therein. The warm air 58 is blown out of the server 20 through ventilation holes 60 on the rear side of the I/O module chassis 42. In addition, an outlet guard 62 is disposed on the inner side of the ventilation holes 60.

Figure 3:
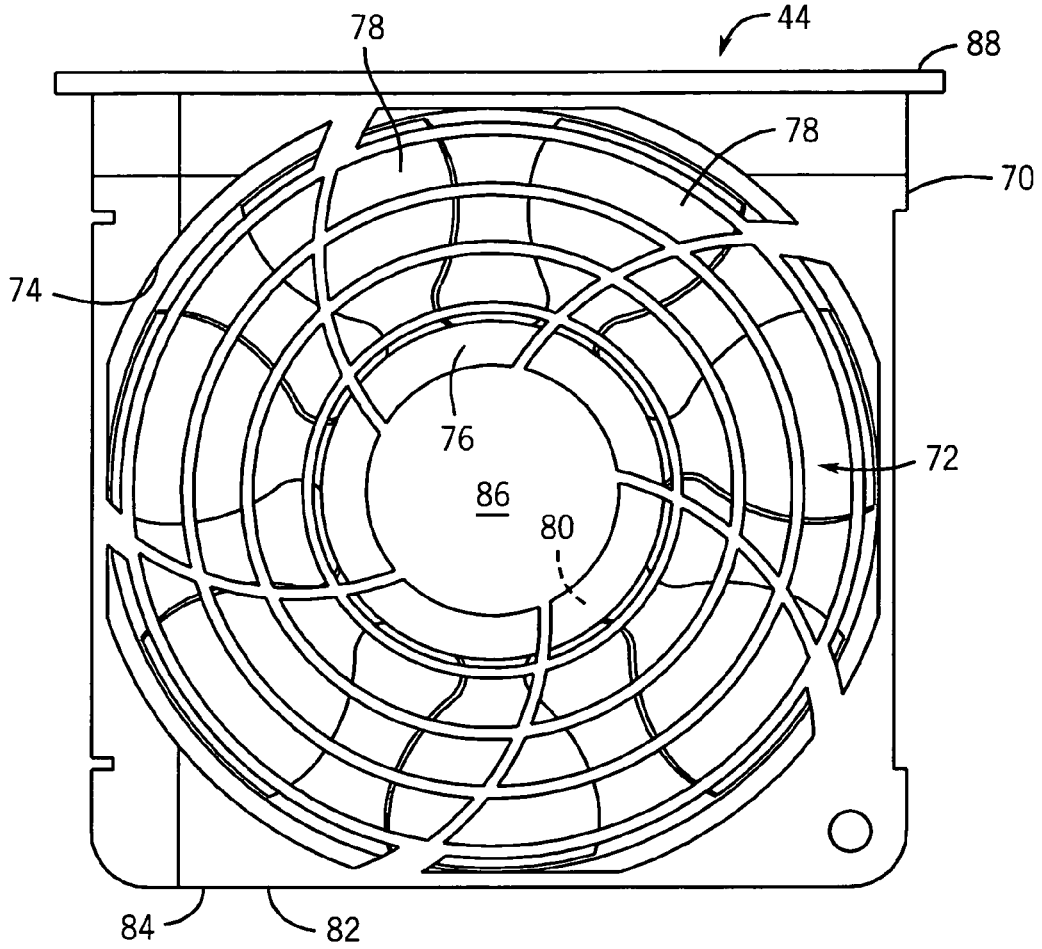
FIG. 3 is a front elevation view illustrating a cooling fan with a three-phase DC motor in accordance with embodiments of the present invention.

Referring generally to FIG. 3, the first fan 44 is illustrated. As noted above, the first fan 44 and the second fan 46 are identical in this embodiment. Therefore, for simplicity, only the first fan 44 is discussed below. The first fan 44 comprises a fan housing 70 and an impeller 72 that rotates within an inner cylindrical portion 74 of the fan housing 70. In the illustrated embodiment, the impeller 72 has a central hub 76 and seven blades 78 that extend outward from the central hub 76 towards the inner cylindrical portion 74 of the fan housing 70. The impeller 72 is rotated by a three-phase DC motor 80 that is housed within the hub 76. A three-phase DC motor is more efficient than a conventional DC motor, which enables the first fan 44 and the second fan 46 to produce a larger flow of air than a comparable cooling fan of the same size that uses a conventional DC motor. A conventional DC motor used in a cooling fan has an efficiency of approximately fifty percent. A three-phase DC motor has an efficiency of approximately seventy percent.

Figure 4:
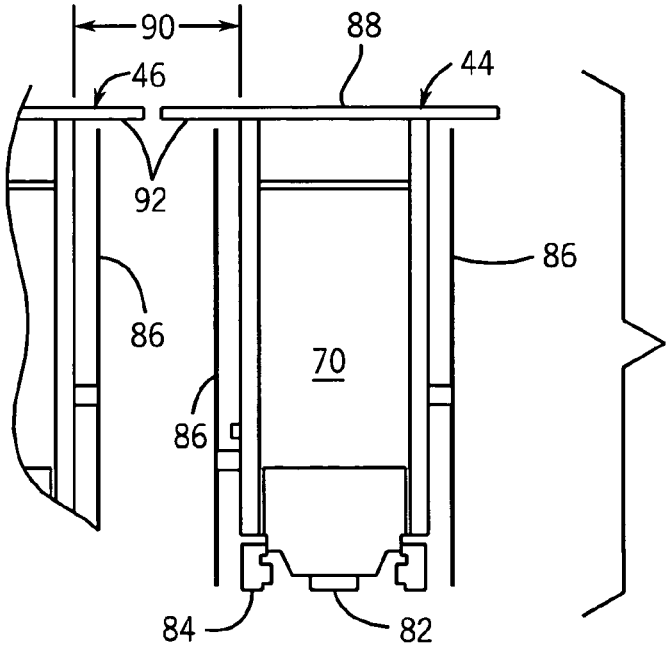
FIG. 4 is a side elevation view of the redundant cooling fans of FIG. 2 in accordance with embodiments of the present invention.

Referring generally to FIGS. 3 and 4, the first fan 44 has an electrical connector 82 that is disposed on a bottom side 84 of the fan housing 70. The electrical connector 82 enables power and control signals to be transmitted to the three-phase DC motor 80 when the first fan 44 is inserted into the server 20. In addition, each fan may include a guard 86 (e.g. a finger guard) on each side of the impeller 72 to prevent objects from being inserted into the blades 78 of the impeller 72. The guards 86 are displaced at a distance from the impeller 72. This displacement reduces the resistance to air flow caused by the guards 86. In addition, the guards 86 have an air foil shape that further reduces the resistance to air flow caused by the guards 86. Each fan housing 70 also has a top piece 88 that extends over the guards 86 and defines the top of the fan tunnel 50.

As illustrated in FIG. 4, a gap 90 is provided between the impellers 72 of the two fans to enable the air 58 to stabilize before it enters the second fan 46, reducing air resistance further. As noted above, the amount of audible noise generated is reduced by reducing the resistance to air flow. The top 88 of each fan housing 70 has an overhang 92 that covers the gap 90 between the first fan 44 and the second fan 46 to prevent air from being diverted into the server 20, rather than to the second fan 46. Preferably, the impeller 72 of the idle fan is able to spin freely. The resistance to the flow of air of a non-operating fan is greater when the impeller 72 is locked than it is when the impeller 72 is able to spin freely.

Figure 5:
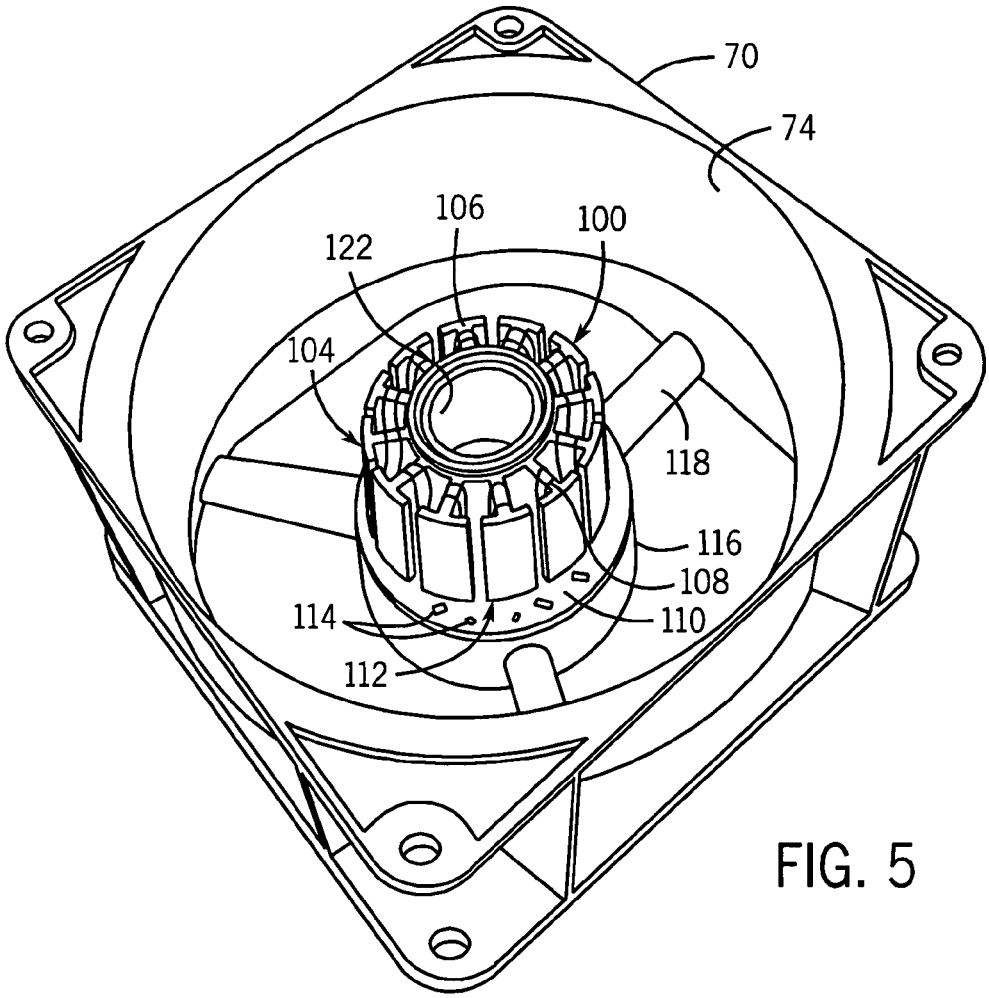
FIG. 5 is a perspective view illustrating the stator of the three-phase DC motor of the cooling fan of FIG. 3 in accordance with embodiments of the present invention.
Figure 6:
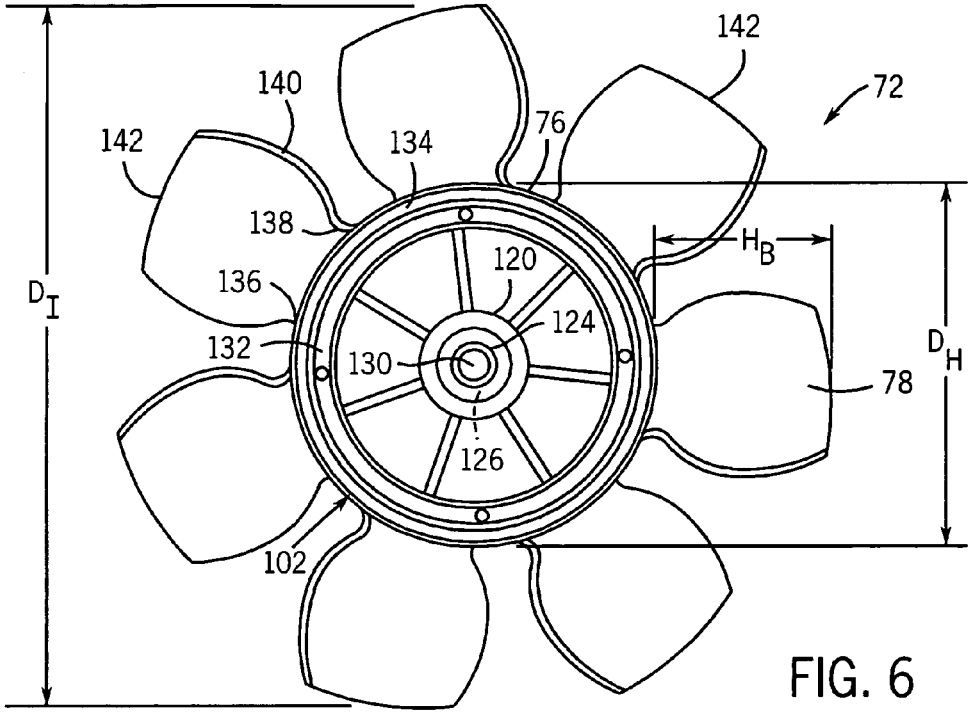
FIG. 6 is a rear elevation view of the impeller of the cooling fan of FIG. 3 in accordance with embodiments of the present invention.

Referring generally to FIGS. 5 and 6, the three-phase DC motor 80 comprises a stator 100 secured to the fan housing 70 and a rotor 102 secured to the fan impeller 72. The stator 100 produces a magnetic field that induces rotation in the rotor 102, thus causing the impeller 72 to rotate.

As illustrated in FIG. 5, the stator 100 comprises a stator core 104 formed of a stack of laminations. The illustrated stator 100 has twelve poles 106. Each pole 106 has a winding 108 that produces a magnetic field when electricity flows through the winding. The windings 108 are coupled together to form three groups, or phases. The stator 100 of the three-phase DC motor 80 is mounted on an annular circuit board 110. In addition, a motor controller 112 for the three-phase DC motor 80 is mounted on the circuit board 110. The motor controller 112 selectively energizes the three groups or phases of the windings to produce a rotating magnetic field around the rotor 102. The rotating magnetic field induces rotation in the rotor 102, which is imparted to the impeller 72.

The motor controller 112 has a plurality of electronic components 114 that are mounted on the circuit board 110 and electrically coupled together through the circuit board 110. The circuit board 110 is secured to a hub 116 of the fan housing 70. In this embodiment, the hub 116 is secured to the fan housing 70 by three support arms 118. The motor controller 112 has various inputs and outputs that are electrically coupled to the electrical connector 82 disposed on the bottom 84 of the fan 44, as illustrated in FIG. 3. These inputs and outputs enable the server 20 to send power and control signals to the fan and to receive data signals from the fan.

As illustrated in FIG. 6, a bearing assembly 120 is provided to support the rotor 102 and to enable the rotor 102 to rotate relative to the stator 100. The bearing assembly 120 is inserted within a cylindrical surface 122 disposed within the stator core 104. The bearing assembly 120 has a first bearing 124 and a second bearing 126. The fan impeller 72 has a shaft 130 that extends through and is supported by the first bearing 124 and the second bearing 126, enabling the fan impeller 72 to rotate freely relative to the fan housing 70. The shaft 130 in the illustrated embodiment is larger in diameter than comparable shafts in other similar sized cooling fan motors. However, the first bearing 124 and second bearing 126 are larger in size than conventional bearings used in cooling fans. In particular, the first and second bearings have a larger ratio of the outer diameter of the bearing to the inner diameter of the bearing than in previous cooling fans. Typically, the ratio of the outer diameter of a bearing to the inner diameter of the bearing in a cooling fan is approximately 2.81. However, in the illustrated embodiment, the ratio of the outer diameter of the bearing to the inner diameter of the bearing is 3.19. The larger ratio enables the bearings to have a larger volume, which enables the bearing to have a greater number of bearing elements within the bearing and increases the bearing surface area. This also enables a greater amount of grease to be placed within the bearings, further reducing friction. In addition, high performance grease is used. As a result, the life of the first bearing 124 and the second bearing 126 has been increased from 45,000 hours to 150,000 hours.

The rotor 102 comprises a rare earth magnet 132. In the illustrated embodiment the rare earth magnet 132 is a bonded neodymium-iron-boron magnet and has eight poles. As noted above, the stator 100 produces a rotating magnetic field that induces rotation of the magnet 132. The magnet 132 is secured to the hub 76. Thus, as the magnet 132 rotates, the hub 76 and blades 78 of the impeller 72 rotate. The rotation of the blades 78 of the impeller 72 induces the flow of air through the fan. The bonded neodymium-iron-boron magnet 132 does not produce cogging torque. Cogging torque occurs when the rotor poles try to align with the stator poles. Cogging torque is undesirable it interferes with the rotation of the rotor 102, making the motor 80 less efficient. The bonded neodymium-iron-boron magnet 132 increases the efficiency of the motor by approximately eight percent over a conventional permanent magnet.

Figure 7:
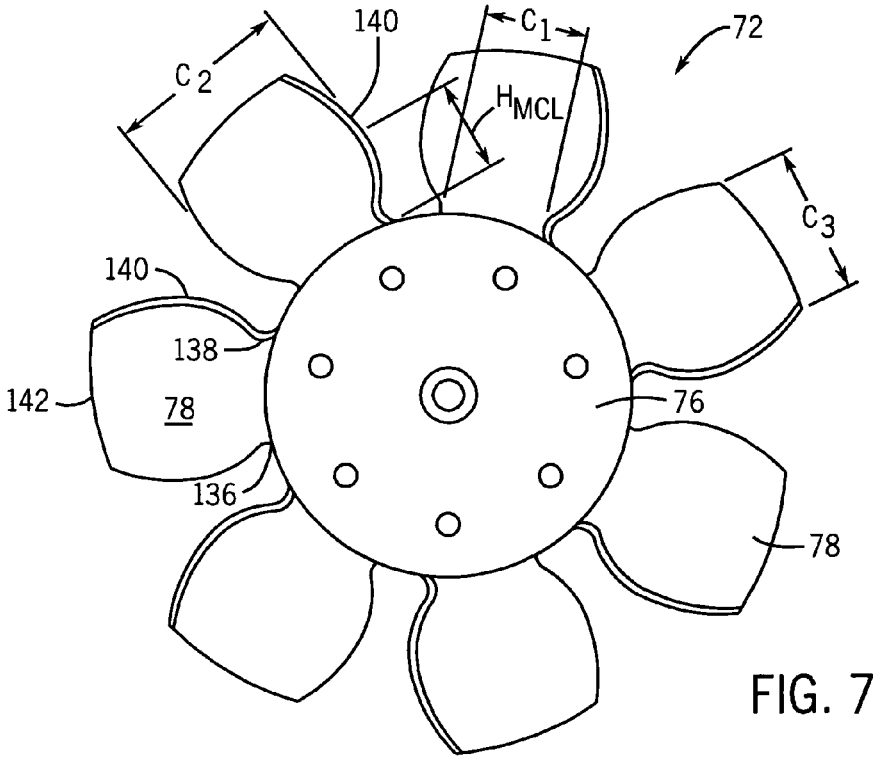
FIG. 7 is a front elevation view of the impeller of the cooling fan of FIG. 3 in accordance with embodiments of the present invention.
Figure 8:
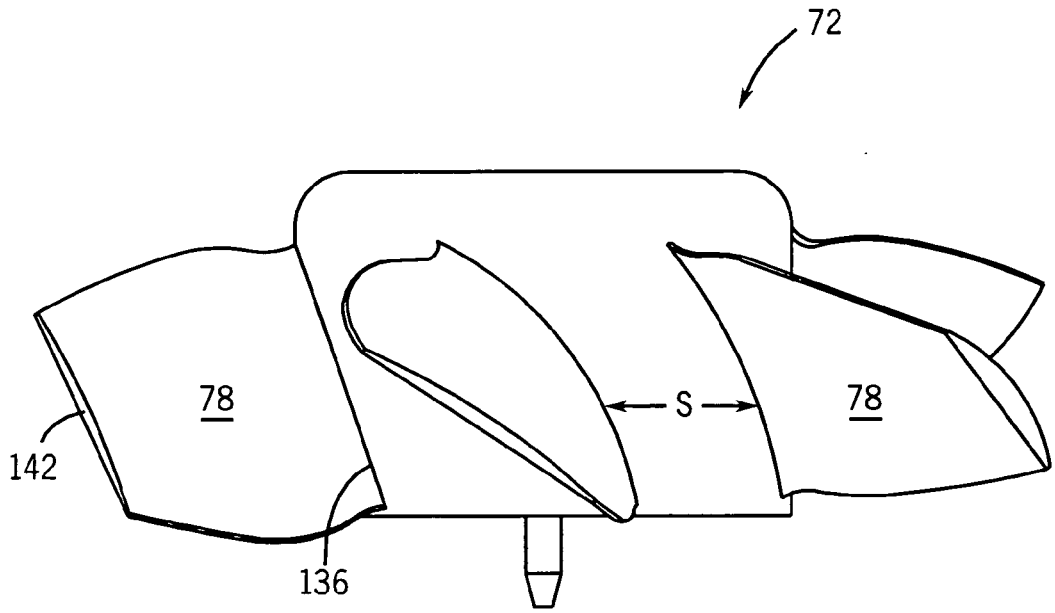
FIG. 8 is a side elevation view of the impeller of the cooling fan of FIG. 3 in accordance with embodiments of the present invention.
Figure 9:
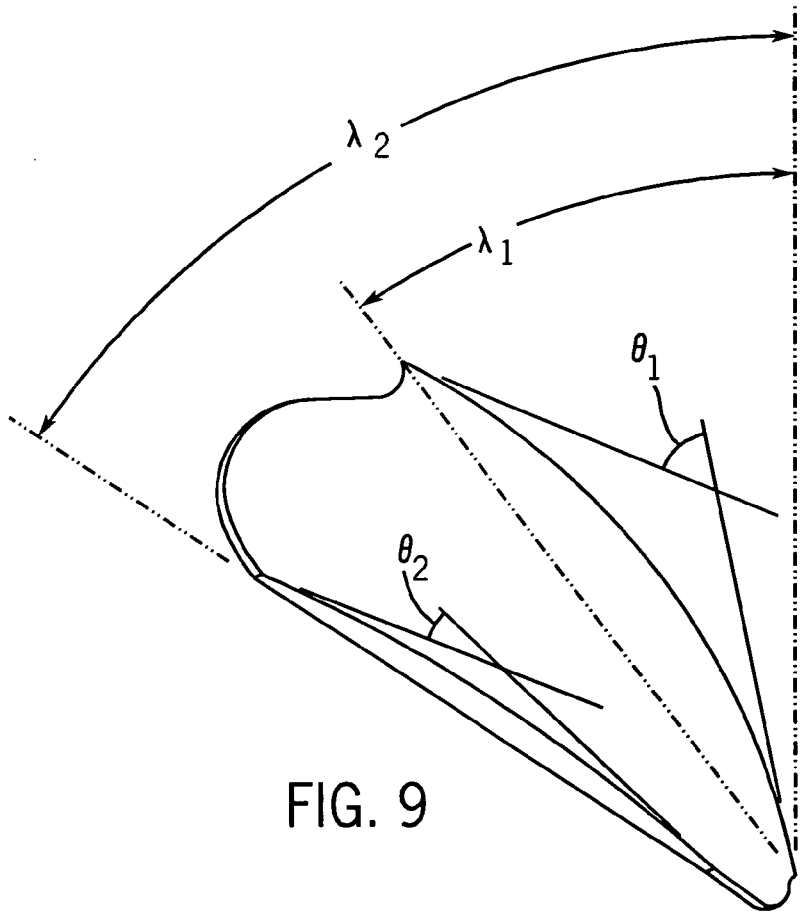
FIG. 9 is a detailed view of an impeller blade of FIG. 9 in accordance with embodiments of the present invention.

Referring generally to FIGS. 6-8, the impeller 72 used in the first fan 44 and the second fan 46 is designed to provide desired flow characteristics when operating and to produce minimal resistance to air flow when idle. For example, each fan is designed to provide a desired flow rate of air at a desired pressure at a given rotational speed of the impeller 72. The constraints imposed on the fans are the height, width, and depth available for the impeller 72 to occupy. In addition, in the illustrated embodiment, the impeller 72 is limited to three inches in depth. However, the techniques described below are applicable to fans of all sizes. By providing an impeller that 72 that minimizes the resistance to air flow when idle, the efficiency of the operating fan is improved and the amount of audible noise generated by the air flowing through the idle fan is reduced.

One factor that affects the flow of air that is produced by the impeller 72 is the blade height ("$H_B$"). The height of the blades is limited by the diameter of inner cylindrical portion 74 of the fan housing 70 and the hub diameter ("$D_H$") of the fan impeller 72. The hub diameter is defined by the size of the motor to be housed therein. The greater efficiency of a three-phase DC motor over a conventional DC motor enables a three-phase motor DC motor to produce the same power as a conventional DC motor but in a smaller volume. In addition, the gap 134 between the outer diameter of the magnet and the inner diameter of the hub 76 also is minimized to reduce the outer diameter of the hub 76. Thus, the hub 76 in the illustrated embodiment is smaller in diameter than a comparable fan that uses a single-phase DC motor. In the illustrated embodiment, the first fan 44 is a 5.5 inch by 5.5 inch cooling fan. However, the present techniques are applicable to fans of all sizes. The impeller diameter ("$D_I$") in the illustrated embodiment, and in a typical impeller for a 5.5 inch by 5.5 inch cooling fan, is 5.25 inches. In a typical cooling fan using a conventional DC motor, the hub diameter is approximately 3.13 inches. Thus, each blade is approximately 1.06 inches. However, the hub diameter ("$D_H$") of the illustrated 5.5 inch by 5.5 inch cooling fan is 2.56 inches and the blade height ("$H_B$") is 1.35 inches long. As a result, the blade height ("$H_B$") in the illustrated embodiment is approximately 25% of the impeller diameter ("$D_I$"), as compared to 20% of the impeller diameter in a fan using a conventional DC motor. This enables the impeller 72 to displace a greater amount of air for each rotation of the impeller than an impeller of a comparable fan powered by a conventional DC motor.

The shape of the blades 78 in the illustrated embodiment has been established to produce the desired flow characteristics when the fan is operating, but also to minimize resistance to air flow when the fan is idle. Reducing the resistance to air flow increases the efficiency of the system and reduces noise. One of these shape characteristics is the "camber" of the blade. Camber is the amount (in degrees) that the blade turns from the leading edge to the trailing edge. For example, a straight line has zero degrees of camber, while a U-turn has one-hundred-and-eighty degrees of camber. An impeller blade having camber will produce pressure, but not efficiently. Another blade characteristic is "stagger." Stagger is the blade setting angle, at any radial location, with respect to the axial direction. For example, a blade having a stagger angle of zero degrees would be aligned with the axis of the impeller. A blade having a stagger of ninety degrees would be perpendicular to the axis of the impeller. Stagger controls the quantity of flow that the fan draws. Still another blade characteristic is the "chord." The chord is the linear distance between the leading edge and the trailing edge. If the blade has any camber, the blade length is larger than the chord. However, if the blade has zero camber, the chord and the length are the same. Finally, a characteristic of the blades of an impeller as a group is the "solidity." Solidity is the ratio of the chord length to the spacing ("S") between the blades. The higher the solidity of the impeller, the greater the resistance to air flow when the fan is idle. Preferably, the solidity is from 0.95 to 1.05. In addition, the resistance to air flow greater if the impeller is locked, rather than spinning freely.

In this embodiment, the impeller 72 has seven blades 78 that each have a "fish-shaped" chord profile, i.e., the chord length of each blade increases from the hub 76 to a maximum chord length height ("$H_{MCL}$") and then decreases. At the base 136 of the blade 78, the blade 78 has a first chord length ("$C_1$"). In the illustrated embodiment, the first chord length ("$C_1$") is 1.3 inches. The chord length decreases slightly from the base 136 of the blade 78 to a narrower portion 138 of the blade 78 just above the hub 76. From the narrower portion 138 of the blade 78, the chord increases to the maximum chord length ("$C_2$") at the widest portion 140 of the blade 78. In the illustrated embodiment, the maximum chord length is 1.8 inches and is at a height ("$H_{MCL}$") of 0.64 inches, which is approximately 47 percent of the ("$H_B$"). In this embodiment, the spacing ("S") between the blades 78 at the maximum chord length height ("$H_{MCL}$") is 1.8 inches. Thus, the impeller 72 has a solidity of one at the maximum chord length ("$C_2$"). The low solidity produced by having smaller chords near the hub 76 hinders stall at speeds below 200 CFM. The chord decreases from the widest portion 140 of the blade 78 to the tip 142 of the blade 78. In the illustrated embodiment, the chord length ("$C_3$") at the tip 142 of the blade 78 is 1.3 inches.

In addition, the stagger of each blade 78 increases from a first stagger angle ("$\lambda_1$") at the hub 76 to a second stagger angle ("$\lambda_2$") at the tip 142. Preferably, the first stagger angle ("$\lambda_1$") is from 24 degrees to 30 degrees and the second stagger angle ("$\lambda_2$") is from 50 degrees to 56 degrees. In this embodiment, the stagger of each blade 78 increases from twenty-nine degrees ("$\lambda_1$") at the hub 76 to fifty-six degrees ("$\lambda_2$") at the tip 142. The camber angle of each blade 78 decreases from the hub 76 to the tip 142. Preferably, the camber angle of each blade 78 at the hub 76 ("$\theta_1$") is from twenty-six degrees to thirty-two degrees and the camber angle ("$\theta_2$") at the tip 142 is from nine degrees to fifteen degrees. In this embodiment, the camber angle of each blade 78 at the hub 76 ("$\theta_1$") is twenty-nine degrees and decreases to twelve degrees at the tip 142 ("$\theta_2$"). The camber of the blades 78 minimizes interference between the fan impellers by producing low blade trailing edge angles. The chord profile, the solidity, the stagger angle, and the camber angle may be modified to produce the desired results.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A cooling fan for an electronic device, comprising:

a three-phase DC motor comprising a stator and a rotor comprising a rare earth magnet; and an impeller comprising a hub to house the three-phase DC motor and a plurality of blades extending from the hub to a tip of each blade, wherein the impeller has an impeller diameter and each blade has a blade height that is at least 25% of the impeller diameter, wherein each blade has a chord profile that increases in chord length from a region proximate to the hub to a maximum chord length at a maximum chord length blade height, and a stagger angle of each blade increases from the hub to the tip of the blade;

wherein:

each blade has a stagger angle of about 24 degrees to 30 degrees at the hub and a stagger angle of about 50 degrees to 56 degrees at the tip.

2. The cooling fan as recited in claim 1, wherein the maximum chord length blade height is approximately half the blade height.

3. The cooling fan as recited in claim 1, wherein the chord profile decreases in chord length from the maximum chord length blade height to the tip of the blade.

4. The cooling fan as recited in claim 1, wherein each blade has a camber angle that decreases from the hub to the tip.

5. The cooling fan as recited in claim 1, wherein each blade has a camber angle of about 26 degrees to 32 degrees at the hub and about 9 degrees to 15 degrees at the tip.

6. The cooling fan as recited in claim 5, wherein each blade has the stagger angle of approximately 29 degrees at the hub and the stagger angle of approximately 56 degrees at the tip, and each blade has the camber angle of approximately 29 degrees at the hub and the camber angle of approximately 12 degrees at the tip.

7. The cooling fan as recited in claim 1, wherein each impeller has solidity of approximately one at the blade height corresponding to the maximum chord length.

8. The cooling fan as recited in claim 1, wherein the impeller has seven blades.

9. An electronic device, comprising:

a first cooling fan, comprising:

a three-phase DC motor; and an impeller comprising a hub to house the three-phase DC motor and a plurality of blades extending from the hub, wherein the impeller has an impeller diameter and each blade has a blade height that is at least 25% of the impeller diameter, and wherein each blade has a chord profile that increases to a maximum chord length and decreases to a lesser chord length, a stagger angle that increases from the hub to the tip of the blade, and a camber angle that decreases from the hub to the tip;

wherein:

the stagger angle increases from about 24 degrees to 30 degrees at the hub to about 50 degrees to 56 degrees at the tip; or the camber angle decreases from about 26 degrees to 32 degrees at the hub to about 9 degrees to 15 degrees at the tip;

or a combination thereof.

10. The electronic device as recited in claim 9, wherein the impeller has a solidity of approximately one at the maximum chord length.

11. The electronic device as recited in claim 9, wherein the maximum chord length is located at approximately forty percent of the full blade height.

12. The electronic device as recited in claim 9, wherein the motor is a three-phase DC motor comprising a stator and a rotor comprising a rare earth magnet.

13. The electronic device as recited in claim 12, wherein the rare earth magnet comprises bonded neodymium-iron-boron.

14. The electronic device as recited in claim 9, comprising:

a second cooling fan in series with the first cooling fan, the second cooling fan comprising:

a motor; and an impeller having a hub and a plurality of blades extending from the hub to a tip, wherein each blade has a chord profile that increases to a maximum chord length and decreases to a lesser chord length, a stagger angle that increases from the hub to the tip of the blade, and a camber angle that decreases from the hub to the tip;

wherein:

the stagger angle increases from about 24 degrees to 30 degrees at the hub to about 50 degrees to 56 degrees at the tip; or the camber angle decreases from about 26 degrees to 32 degrees at the hub to about 9 degrees to 15 degrees at the tip;

or a combination thereof.

15. The electronic device as recited in claim 9, comprising a bearing assembly operable to rotatably support the impeller, wherein the bearing assembly comprises a plurality of bearings each having an outer diameter at least three times the inner diameter.

16. The electronic device as recited in claim 9, wherein the stagger angle increases from approximately 29 degrees at the hub to approximately 56 degrees at the tip, and the camber angle decreases from approximately 29 degrees at the hub to approximately 12 degrees at the tip.

17. A method of manufacturing a redundant cooling fan for an electrical device, comprising;

manufacturing each blade of an impeller to have an increasing chord profile from a base region of the blade to a maximum chord length at a specified blade height, wherein the cooling fan has a three-phase DC motor and the impeller comprises a hub to house the three-phase DC motor, wherein each blade extends from the hub, and wherein the impeller has an impeller diameter and each blade has a blade height that is at least 25% of the impeller diameter; and manufacturing each blade with a stagger angle that increases from the base region of the blade to a tip of each blade; and manufacturing each blade with a camber angle that decreases from the base region of the blade to the tip;

wherein:

the stagger angle increases from about 24 degrees to 30 degrees at the base region of the blade to about 50 degrees to 56 degrees at the tip of the blade; or the camber angle decreases from about 26 degrees to 32 degrees at the base region of the blade to about 9 degrees to 15 degrees at the tip of the blade; or a combination thereof.

18. The method as recited in claim 17, comprising manufacturing each blade of the impeller to have a decreasing chord profile from the maximum chord length to a lesser chord length at the blade tip.

19. The method as recited in claim 17, comprising manufacturing the impeller with a solidity of approximately one at the maximum chord length.

20. The method as recited in claim 17, comprising manufacturing a three-phase DC motor comprising a stator and a rotor comprising a rare earth magnet, and wherein the stagger angle increases from approximately 29 degrees at the base region of the blade to approximately 56 degrees at the tip of the blade, and the camber angle decreases from approximately 29 degrees at the base region of the blade to approximately 12 degrees at the tip of the blade.

21. A cooling fan comprising:

a three-phase DC motor;

an impeller comprising a hub to house the three-phase DC motor and a plurality of blades extending from the hub, wherein the impeller has an impeller diameter and each blade has a blade height that is at least 25% of the impeller diameter a fan housing to house the impeller; and a pair of finger guards secured to opposite sides of the fan housing, each finger guard being displaced outward relative to the fan housing, wherein the fan housing comprises a top that extends crosswise over the pair of finger guards and overhangs the flow path outside the pair of finger guards.

22. The cooling fan as recited in claim 21, wherein the motor comprises a three-phase DC motor.

23. The cooling fan as recited in claim 21, wherein the in1peller comprises a hub and a plurality of blades extending from the hub to a tip, wherein each blade has a chord profile that increases to a maximum chord length and decreases to a lesser chord length, a stagger angle that increases from the hub to the tip of the blade, and a camber angle that decreases from the hub to the tip.

24. The cooling fan as recited in claim 21, wherein the impeller has a solidity of one at the blade height corresponding to the maximum chord length.

25. The cooling fan as recited in claim 21, wherein the top is generally perpendicular to the opposite sides of the fan housing.

26. The cooling fan as recited in claim 21, wherein the motor is a three-phase DC motor comprising a stator and a rotor comprising a rare earth magnet, and wherein the impeller comprises a hub and a plurality of blades each extending from the hub to a tip of the respective blade, wherein each blade has a stagger angle which increases from about 24 degrees to 30 degrees at the hub to about 50 degrees to 56 degrees at the tip, or each blade has a camber angle which decreases from about 26 degrees to 32 degrees at the hub to about 9 degrees to 15 degrees at the tip, or a combination thereof.

27. A cooling fan for an electronic device, comprising:

a three-phase DC motor comprising a stator and a rotor comprising a rare earth magnet;

an impeller comprising a hub to house the three-phase DC motor, and a plurality of blades each extending from the hub to a tip of the respective blade, wherein the impeller has an impeller diameter and each blade has a blade height that is at least 25% of the impeller diameter;

a fan housing to house the impeller; and a pair of finger guards secured to opposite sides of the fan housing, each finger guard being displaced outward relative to the fan housing, wherein the fan housing comprises a top that extends crosswise over the pair of finger guards and overhangs the flow path outside the pair of finger guards;

wherein each blade has a stagger angle which increases from about 24 degrees to 30 degrees at the hub to about 50 degrees to 56 degrees at the tip, or each blade has a camber angle which decreases from about 26 degrees to 32 degrees at the hub to about 9 degrees to 15 degrees at the tip, or a combination thereof.

* * * * *